US007746208B2

(12) United States Patent
Loef et al.

(10) Patent No.: US 7,746,208 B2
(45) Date of Patent: Jun. 29, 2010

(54) INTERLEAVED PLANAR TRANSFORMER PRIMARY AND SECONDARY WINDING

(75) Inventors: Christoph Loef, Aachen (DE); Bernd Ackermann, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 73 days.

(21) Appl. No.: 12/097,757

(22) PCT Filed: Dec. 8, 2006

(86) PCT No.: PCT/IB2006/054703

§ 371 (c)(1),
(2), (4) Date: Jun. 17, 2008

(87) PCT Pub. No.: WO2007/072282

PCT Pub. Date: Jun. 28, 2007

(65) Prior Publication Data

US 2009/0002116 A1 Jan. 1, 2009

(30) Foreign Application Priority Data

Dec. 19, 2005 (EP) ..... 05112357

(51) Int. Cl.
*H01F 5/00* (2006.01)
*H01F 27/28* (2006.01)
*H01F 27/30* (2006.01)

(52) U.S. Cl. ..... 336/200; 336/232; 336/206; 336/207; 336/208; 336/222

(58) Field of Classification Search ..... 336/200, 336/206–208, 222, 232
See application file for complete search history.

(56) References Cited

U.S. PATENT DOCUMENTS

| | | | | |
|---|---|---|---|---|
| 3,466,580 | A * | 9/1969 | Bull | 335/213 |
| 3,587,019 | A * | 6/1971 | Bull et al. | 336/200 |
| 4,939,400 | A * | 7/1990 | Matsushita et al. | 310/208 |
| 5,392,020 | A * | 2/1995 | Chang | 336/200 |
| 6,831,544 | B2 | 12/2004 | Patel et al. | |
| 2002/0157849 | A1 * | 10/2002 | Sakata | 174/52.1 |
| 2003/0001709 | A1 | 1/2003 | Visser | |
| 2003/0179067 | A1 | 9/2003 | Gamou et al. | |
| 2004/0017278 | A1 | 1/2004 | Castaneda et al. | |
| 2005/0104706 | A1 | 5/2005 | Chou | |

FOREIGN PATENT DOCUMENTS

| | | | |
|---|---|---|---|
| FR | 2141551 | A | 1/1973 |
| WO | 03005381 | A1 | 1/2003 |
| WO | 03012879 | A1 | 2/2003 |
| WO | 2006117739 | A1 | 11/2006 |

* cited by examiner

*Primary Examiner*—Elvin G Enad
*Assistant Examiner*—Tszfung Chan

(57) ABSTRACT

The present invention describes a winding for a transformer comprising first (60) and second (70) planar sections which are arranged parallel to each other. First (1, e.g., from 602 to 603)) and second (2, e.g., from 703 to 704)) current paths are arranged on the first and second planar sections. The first and second current paths are connected to each other by means of an interconnection (603/703). The first and second current (603/703) paths are respectively angled with respect to a direction along which the first and second planar sections are extending.

13 Claims, 4 Drawing Sheets

INTERLEAVED PLANAR TRANSFORMER PRIMARY AND SECONDARY WINDING

The present invention relates to the field of transformers and transformer windings, in particular windings for high voltage transformers such as they may be used for X-ray tubes and computer tomography apparatus. In particular, the present invention relates to a winding for a transformer and to a computer tomography apparatus.

High voltage transformers are key modules of high voltage generators supplying high power (peak voltages higher than 100 kW) at high voltages (peak values higher than 100 kV) to X-ray tubes for medical diagnostics. There is a trend towards even higher power levels in order to improve an imaging quality. Reducing a size and weight of high voltage transformers and generators in particular in the field of computer tomography apparatus is always desired since this may enable an increase of a rotational speed of the gantry which may also result in an improved imaging quality.

There may be a need for increasing power density of high voltage transformers.

According to an exemplary embodiment of the present invention, a winding for a transformer, in particular for a high voltage transformer is provided comprising a first planar section and a second planar section. The first planar section is parallel to the second planar section. The first and second planar sections extend along a first direction which according to a variant of this exemplary embodiment may be in circular direction. Furthermore, there is provided a first current path and a second current path and a first interconnection. The first interconnection connects the first current path to the second current path. The first current path extends on the first planar section in a second direction and the second current path extends on the second planar section in a third direction. The second and third directions are respectively angled to the first direction and the second direction is at least partially opposite to the third direction.

If for example a cylindrical transformer is provided, current paths may be arranged parallel to each other and may be interleaved using parallel cylindrical turns onto (adjacent) layers or planar sections of the winding arrangement. At several locations, for example periodically on the circumference of the layers, each current path moves from its current turn to a neighbouring turn on the respective adjacent layer. According to an aspect, all current paths on one layer may move into the same direction. This direction is opposite for two adjacent layers or planar sections. A current path that has reached an edge of one layer moves to the other layer i.e. there may be a connection between the current paths on the respective layers which may be made by an interconnection. Such turns may be provided with different widths. For example, the inner cylindrical turn may be thinner or smaller than the respective outer turns.

These and other aspects of the present invention will become apparent from and elucidated with reference to the embodiments described hereinafter.

Exemplary embodiments of the present invention will be described in the following, with reference to the following drawings.

In the following description, the same reference numerals are used to designate the same or corresponding elements in FIGS. 1 to 8.

Figure 1:
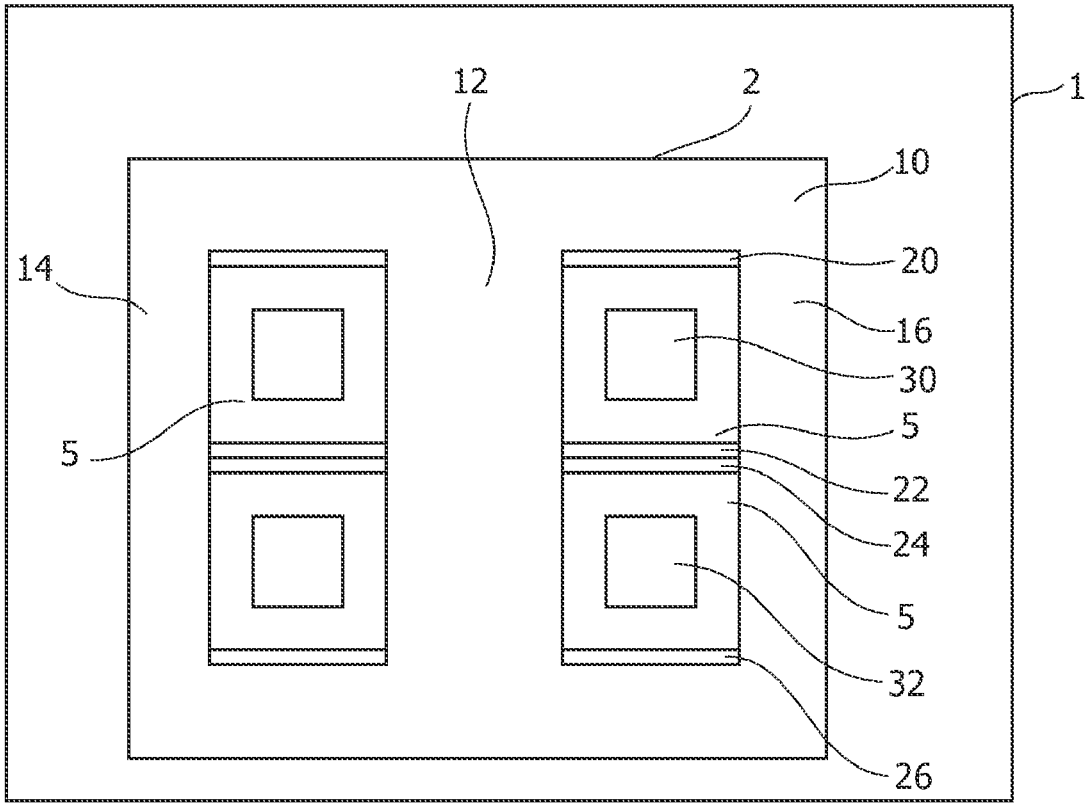
FIG. 1 shows a computer tomography apparatus with a planar high voltage transformer according to an exemplary embodiment of the present invention comprising a winding for a transformer according to an exemplary embodiment of the present invention.

Reference numeral 1 in FIG. 1 indicates a computer tomography apparatus comprising a planar high voltage transformer 2. Primary windings 20, 22, 24 and 26 of the planar high voltage transformer exhibit an aspect ratio that is typical for planar windings: The horizontal dimension is large compared with the vertical dimension. As a consequence, heat generated in such primary winding may be removed via its upper and lower surfaces. However, the high voltage secondary windings 30 and 32 usually require a large number of turns. Therefore, the vertical dimensions will be comparable to the horizontal dimensions. As a consequence, heat should be removed from the centre of a secondary winding stack such as the ones depicted in 30 and 32. The transformer, in particular the secondary windings may be embedded into a cooling medium 5, such as transformer oil.

The cross-sectional view of the planar transformer depicted in FIG. 1 shows that primary windings 20, 22, 24 and 26 and secondary windings 30 and 32 are wound around the centre leg 12 of a core 10. Furthermore, there are provided outer legs 14 and 16.

Figure 2:
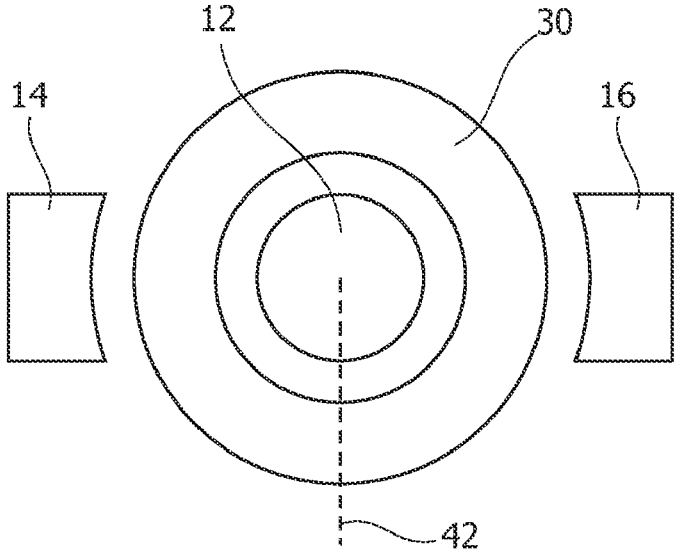
FIG. 2 shows a horizontal cross-sectional view through a secondary winding stack according to an exemplary embodiment of the present invention of the transformer of FIG. 1.

FIG. 2 shows a horizontal cross-section through one winding stack (winding stack 30) of the secondary windings stacks 30 and 32. The cross-sectional view depicted in FIG. 2 through the secondary winding stack shows the centre leg 12 and the outer legs 14 and 16 of the core. In the following FIGS. 3, 4, 5 and 6, the respective windings are shown in rectangular shape instead of a cylindrical shape allowing for a better presentation. However, the opening of the cylindrical shape results in horizontal borders which correspond to line 42 depicted in FIG. 2.

Figure 3:
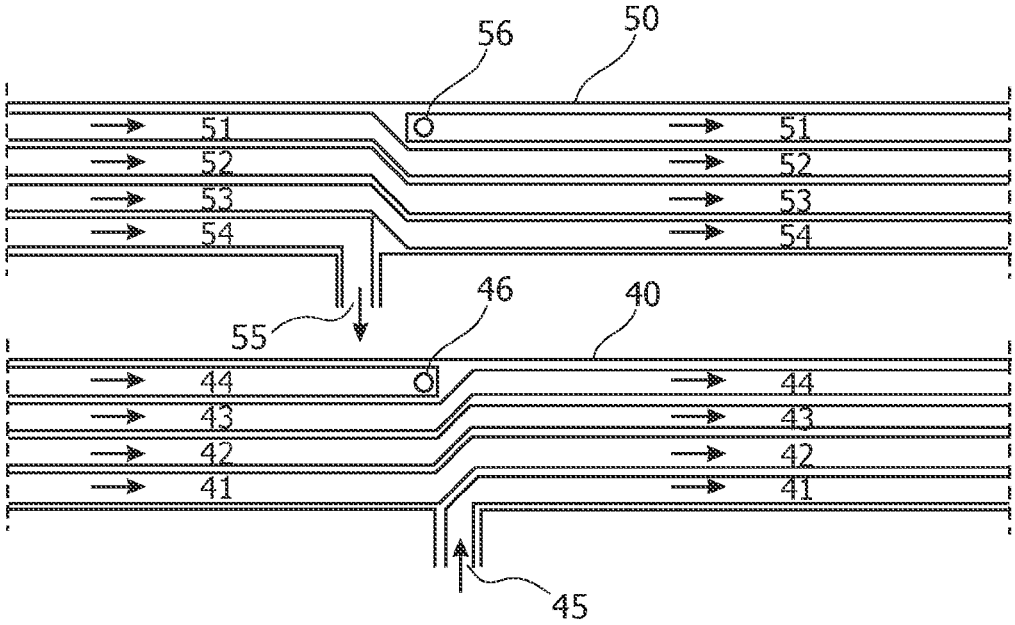
FIG. 3 shows two layers of a secondary winding.

FIG. 3 shows two layers 40 and 50 of a secondary winding with four turns each as it may be used in such a winding stack. Actually, these turns as already indicated above have the same cylindrical shape as the winding stack 30 depicted in FIG. 2 rather than the rectangular shape shown in FIG. 3. However, the rectangular shape is used to present the winding layout in a more concise way.

The current enters layer 40 through terminal 45, passes subsequently through turns 41, 42, 43 and 44, passes from layer 40 to layer 50 at the through connect 46/56, then passes subsequently through turns 51, 52, 53 and 54 and finally leaves layer 50 at terminal 55.

It may be difficult to remove heat from the inner turns 42, 43, 52, 53 if these layers are located close to the centre of the winding stack 30 in the vertical direction in FIG. 1. The heat has to pass either through several insulating layers in the vertical direction or through several cylindrical rings of insulation in the radial direction. In a high voltage secondary winding, this problem may become critical since there will be considerably more turns than the four turns per layer shown in FIG. 3.

Usually, the insulating material has a poor thermal conductivity and therefore, these regions hamper a remove of heat. In addition to these heat paths, heat may also be transported along the cylindrical copper turns that are all interconnected. However, this results in a long path with a small cross-section and does therefore not increase significantly conduction of heat in the radial direction in spite of the good thermal conductivity of copper.

Figure 4:
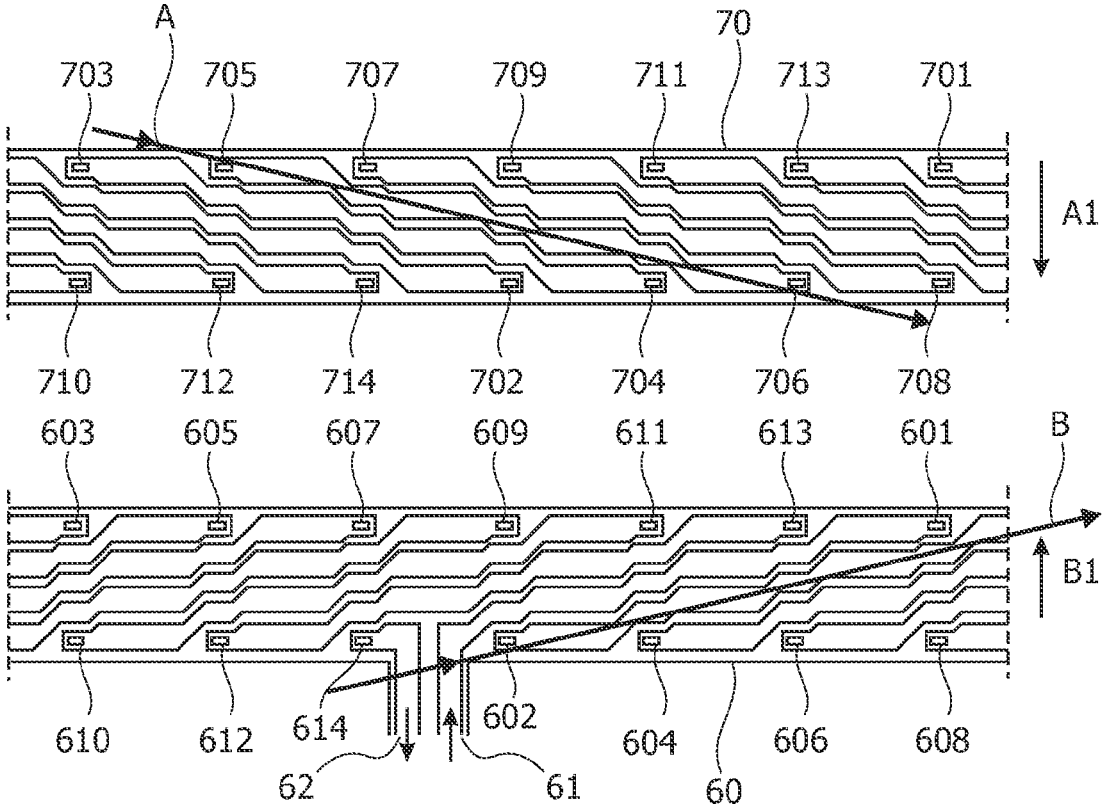
FIG. 4 shows two layers of a secondary winding according to an exemplary embodiment of the present invention.

FIG. 4 shows two layers of a secondary winding according to an exemplary embodiment of the present invention as it may be used in the transformer depicted in FIGS. 1 and 2. Reference numeral 60 designates a first layer and reference numeral 70 designates a second layer. These layers may be adjacent layers of the secondary winding 30 and may be arranged one above the other. As may be taken from FIG. 4, the current enters layer 60 at terminal 61. Then, it flows to through-connect 601/701 and changes to the layer 70. Then, it flows to another through-connect 602/702 and then flows back to layer 60. This interleaving conductance of the current is continued until it reaches through-connect 614/714 and then leaves layer 60 through the terminal 62.

As may be taken from FIG. 4, following the current path, a distance between subsequent through-connects such as 701/702 and 602/603 is relatively short in comparison to for example the current path from the outside connection 45 to the through-connect 46 in FIG. 3. Furthermore, these through-connects are locally close to the surface of the secondary winding block and may thus be in a good thermal-contact with the cooling medium 5, e.g. transformer oil, surrounding the secondary winding block as depicted in FIG. 1. In other words, the through-connects are at the inner/outer surface of the winding block and thus in a good thermal contact to the cooling medium 5 embedding the winding block. In particular, there may be a good thermal contact between the secondary winding block and the surrounding cooling medium since the through-connects are parallel to the surface of the secondary winding block for a considerable distance. Thus, heat may be transported from any part of the winding to the outer surface of the secondary winding block and therefrom to the surrounding cooling medium at an improved rate in comparison to a winding arrangement as depicted in FIG. 3.

As already indicated above, the current path (for example the one from 705 to 706) may be realized by copper layers.

As may be taken from FIG. 4, the layers are extending essentially parallel to each other and in the representation of FIG. 4 basically horizontally. A main direction of the current path on the layer 70 is indicated with reference sign A. As indicated by reference sign A, a main direction of the current path is from the left up side to the right lower side. In other words, the main direction of the current path is angled to a main direction along which the layer 70 extends, which is, in FIG. 4, the horizontal direction. Also, as indicated with the reference sign B, the main direction of the current path on the layer 60 is from the left lower side to the upper right side. All current paths on the layer 70 have basically the same direction. Also, all current paths on the layer 60 also do have essentially the same direction. As on the layers 70, the main direction of the current paths is angled to the main direction along which the layer 60 is extending (in FIG. 4 angled to the horizontal). As indicated with reference signs A1 and B1, the main directions A and B are angled to the horizontal direction in an opposite way. Preferably, in the representation of FIG. 4, an angle of the main direction A to the horizontal direction equals the angle between the main direction B and the horizontal direction. However, these angles do have opposite algebraic signs or opposite directions.

Or, as may be said in other words, the vector component of the main directions A and B which are not parallel to the horizontal direction are opposite to each other.

Also, as may be in particular taken from FIG. 4, the current paths may extend in steps i.e. do not necessarily need a homogeneous direction along their paths but may include portions which are extending horizontally and portions which are extending more angled to the horizontal direction as the main direction.

The current supply via terminal 61 and 62 is usually at the outside of the respective cylindrical winding. Thus, the respective upper sides in FIG. 4 are the respective inner sections of the secondary winding with a cylindrical shape. In the variant of this exemplary embodiment, a width of the respective current path may decrease towards the respective inner sides i.e. towards the upper sides in the representation of FIG. 4.

In FIG. 4 the parts 61/601 and 612/613 in layer 60, and 701/702 and 713/714 in layer 70, of the current path have the highest voltage difference to each other. To avoid a voltage breakthrough between those current paths, a distance between those two current paths may be increased in comparison to the other current paths.

Figure 5:
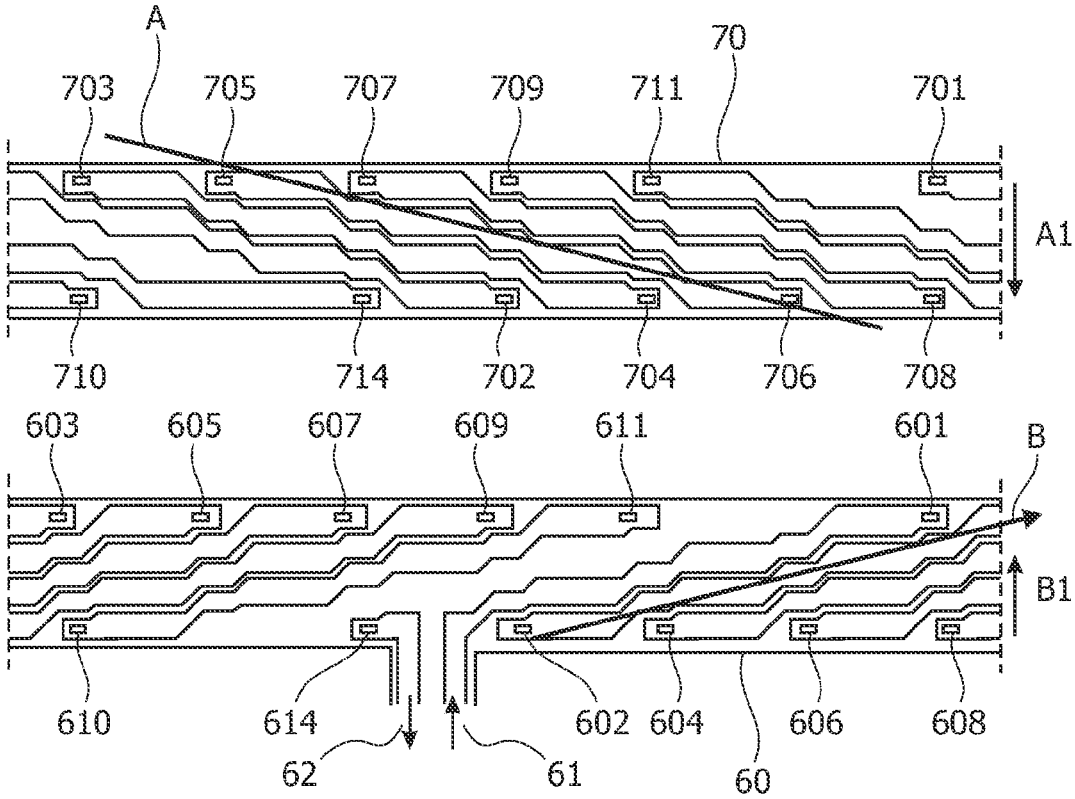
FIG. 5 shows two layers of a secondary winding according to another exemplary embodiment of the present invention.

FIG. 5 shows another exemplary embodiment of two layers of the secondary winding as it may be used in the transformer depicted in FIGS. 1 and 2. As may be taken from FIG. 5, a distance between the copper layers of the current paths has been increased by removing the parts 612/613 and 713/714 of the current paths. The end point of the part 711/712 of the current path has been moved from through-connect 712 to through-connect 714. By this, an insulation between the current paths which show the highest voltage difference is increased and by this, an improved breakthrough protection for these current paths may be provided.

Figure 6:
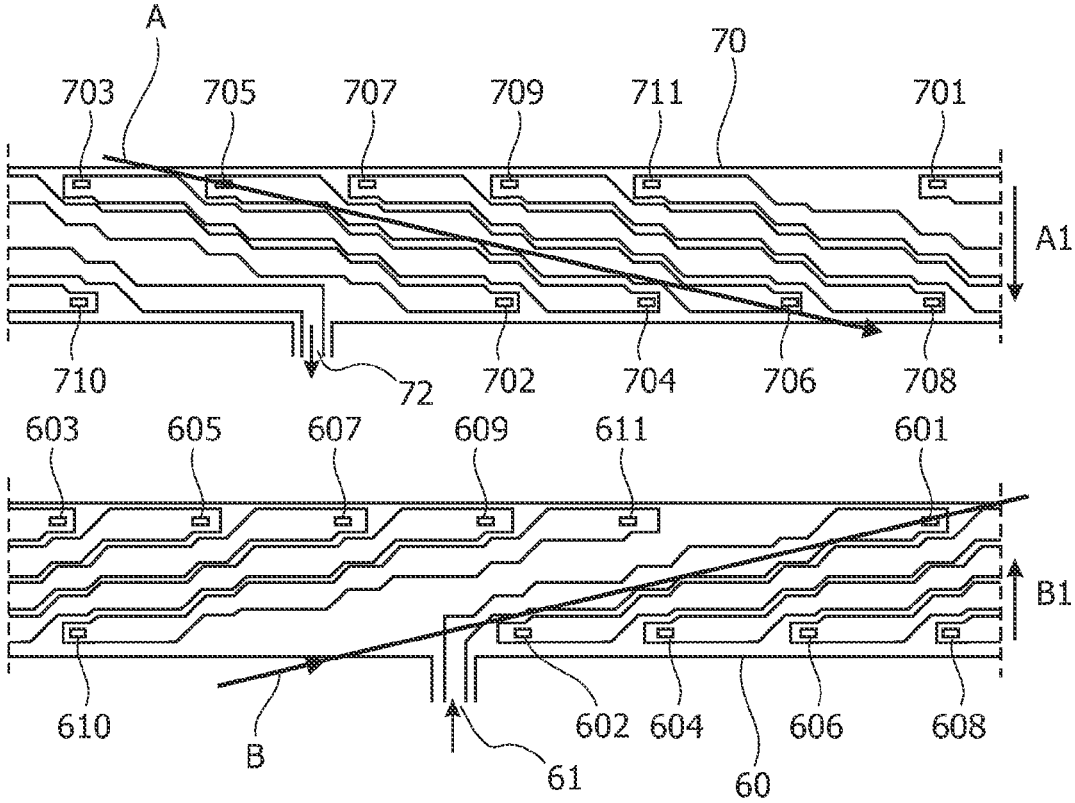
FIG. 6 shows two layers of a secondary winding according to another exemplary embodiment of the present invention.

FIG. 6 shows two layers of a secondary winding according to another exemplary embodiment of the present invention as it may be used and applied in the transformer depicted in FIGS. 1 and 2. As may be taken from FIG. 6, in comparison to FIGS. 4 and 5, one current input terminal 61 is arranged on layer 60 and the other output terminal 72 is arranged on layer 70. By this, a distance between the respective terminals is increased allowing for an increased insulation between the terminal 61 and 71.

In the above FIGS. 4 to 6, the current path on the windings shows a stepwise change of the respective directions and in their diameters. It should be noted that this may also be done in a linear way. Also, instead of changing diameters, a width of the respective current path may be changed. Also, a thickness of the respective current path may be adapted to the respective load.

It is believed that the exemplary embodiments of secondary windings depicted in FIGS. 4 to 6 allow for an improved cooling and thereby allow for an improved or higher power density of high voltage transformers for example for high voltage generators for X-ray tubes. This may be advantageous for reducing volume and height required for high voltage generation on a gantry of computer tomographs.

Figure 7:
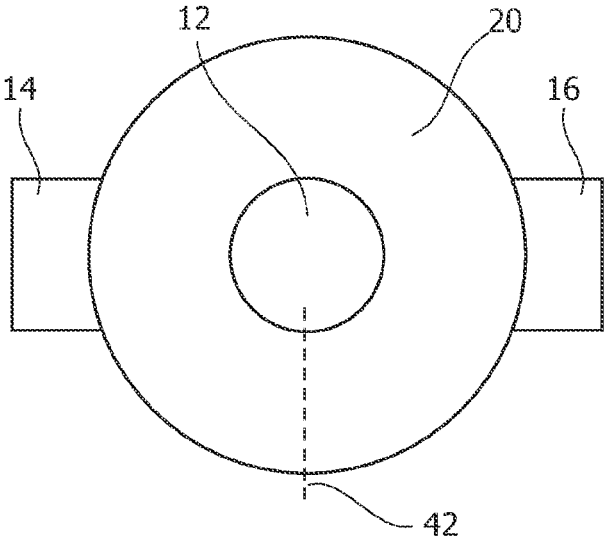
FIG. 7 shows a horizontal cross-sectional view through a primary winding of the transformer of FIG. 1.

FIG. 7 shows a horizontal cross-section through one winding 20 of the primary windings 20, 22, 24 and 26 of the planar high voltage transformer depicted in FIG. 1. The primary winding has to carry a large current. Therefore, one single turn may be made on each layer of the primary winding that uses almost the complete width of the winding. In other words, the primary windings may be single turn windings. Due to the cylindrical shape of the current path, the current will flow mainly close to the inner radius of the turn which results in large current densities and losses in the inner peripheral regions of the winding. Such single turn may be split up in a plurality of parallel turns which are separated by gaps. This however, may not significantly improve the situation since the majority of the current will flow in the turn that is closest to the inner radius of the layer.

Figure 8:
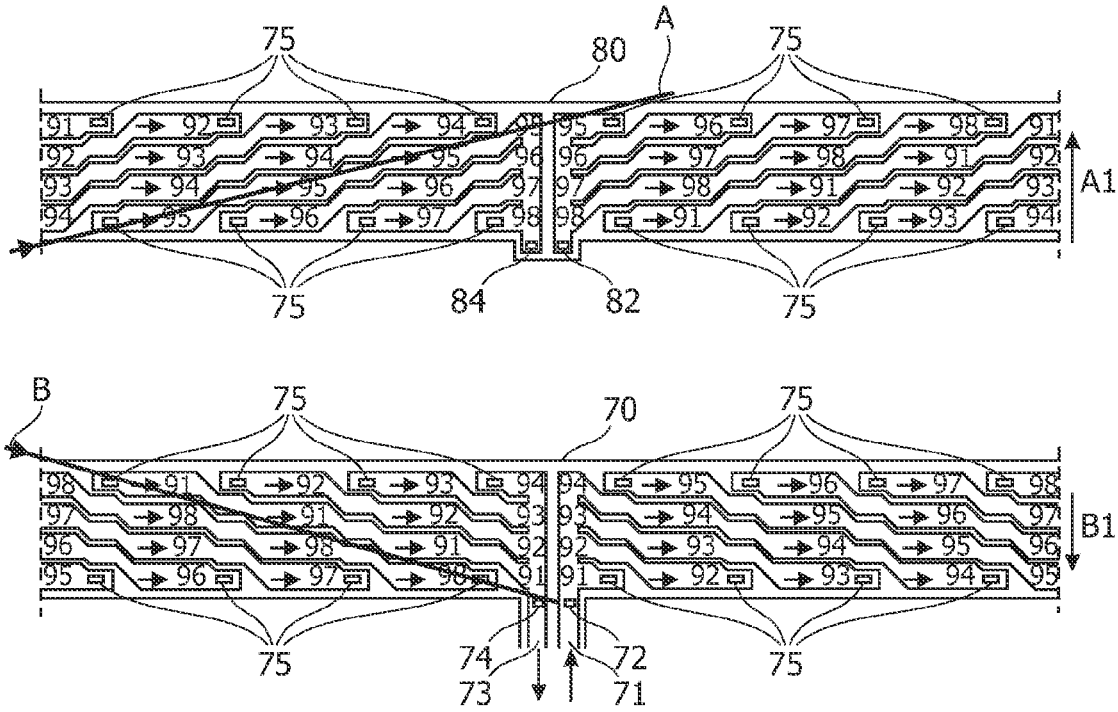
FIG. 8 shows two layers of a primary winding according to an exemplary embodiment of the present invention as it may be used in the transformer of FIG. 1.

FIG. 8 shows two layers according to an exemplary embodiment of a primary winding as it may be used in the transformer depicted in FIG. 1. As in FIGS. 4 to 6, a parallel and not cylindrical representation is used for presenting the arrangement of the respective current path on the layers 70 and 80. As in the above exemplary embodiments of the secondary windings, the two layers 70 and 80 are used to interleave the current path 91, 92, 93, 94, 95, 96, 97 and 98. The current is entered in terminal 71 and distributed along the width of the layer 70. The current flow flowing into terminal 71 is split between the two layers 70 and 80 at the through connection 72/82. From the through connection 82 it is distributed along the width of the layer 80. On the layers 70 and 80, the currents immediately split into the respective parallel current path 91 to 98 which as the current path in FIGS. 4 to 6 essentially extend in a main direction A and B which is respectively angled to the horizontal direction along which the layers 70 and 80 extend in FIG. 8. As in FIGS. 4 to 6, A and B are respectively angled to the horizontal at basically the same angles. However, these angles respectively have opposite mathematical signs or directions. Also, as already indicated with reference to the above embodiments of the secondary windings, the vector components of A and B not parallel to the horizontal namely A1 and B1 are opposite to each other.

After having moved almost completely around the centre leg 12 of the transformer, the parallel current paths 91 to 98 are connected again to each other in a widthwise direction of the layer 70 and 80. At these connection points, there is provided another through connection 74/84 by which the current is returned to the layer 70 where it quits the layer 70 at terminal 73.

Through-connections 75 are provided through which the current paths can change from a turn of one layer to the subsequent turn of the respective other layer. The current path moves from one turn to a neighbour turn at the location of these through connections that may be distributed periodically around the circumference of the layer. Due to this arrangement, each current path covers essentially the same fraction of each turn of the two layers. This may make the current paths equivalent as to their electromagnetic behaviour and the total current will be distributed essentially uniformly between them. Due to this, it is believed that currents in individual current paths may be reduced. Furthermore, it is believed that this may allow for a uniform current distribution.

The primary winding structure according to an exemplary embodiment of the present invention is believed to allow for lower losses and for an increase of the power density of high voltage transformers for high voltage generators for X-ray tubes. It may in particular be useful for reducing a volume and weight required for the high voltage generation on a gantry of computer tomographs.

As indicated above, a transformer according to an exemplary embodiment may comprise a secondary winding arrangement as described with reference to FIGS. 2 to 6 or a primary winding arrangement as described with reference to FIGS. 7 to 8. In particular, such transformers and/or such winding arrangements may be applied in applications where high power densities are required such as for high voltage transformers for high voltage generators for X-ray tubes in medical diagnostics. However, it should be noted that such winding arrangements may also be applied in all kinds of power transformers.

It should be noted that comprising does not exclude other elements or steps and that "a" or "an" does not exclude a plurality. Furthermore, reference signs should not be used for limiting the scope of the claims.

The invention claimed is:

1. A transformer winding comprising:

a first planar section having a first outer edge and a first inner edge, the first planar section comprising a first series of cylindrical turns, each cylindrical turn of the first series comprising a first end and a second end, wherein the first end is at the first outer edge and the second end is at the first inner edge, and each cylindrical turn of the first series comprising a current path spiraling from the first outer edge to the first inner edge;

a second planar section having a second outer edge and a second inner edge, the second planar section comprising a second series of cylindrical turns substantially parallel to the first series of cylindrical turns, each cylindrical turn of the second series comprising a first end and a second end, wherein the first end is at the second inner edge and the second end is at the second outer edge, each cylindrical turn of the second series comprising a current path spiraling from the second inner edge to the second outer edge;

wherein the direction of travel of the spiral axis of the first series of cylindrical turns is substantially opposite to the direction of travel of the spiral axis of the second series of cylindrical turns;

wherein the first and second planar sections are arranged so that the first ends of the first series of cylindrical turns are spaced apart along the first outer edge, the second ends of the first series of cylindrical turns are spaced apart along the first inner edge, the first ends of the second series of cylindrical turns are spaced apart along the second inner edge, and the second ends of the second series of cylindrical turns are spaced apart along the second outer edge, wherein the cylindrical turns traverse a portion of a circle;

wherein each first end of the first series of cylindrical turns is adjacent to and interconnected to one of the second ends of the second series of cylindrical turns, so that when a cylindrical turn of the second series of cylindrical turns reaches the second outer edge, then the current path moves to the first planar section;

wherein each second end of the first series of cylindrical turns is adjacent to and interconnected to one of the first ends of the second series of cylindrical turns, so that when a cylindrical turn of the first series of cylindrical turns reaches the first inner edge, then the current path moves to the second planar section, thereby interleaving the conductance of the current through the first and second planar sections;

wherein the current flows in the same circular direction in the first and second series of cylindrical turns, and a single continuous current path is formed by the first and second series of cylindrical turns in the first and second planar sections.

2. The winding of claim 1, wherein the first and second planar sections are each formed into a cylinder.

3. The winding of claim 1, wherein the first and second planar sections are formed into concentric cylinders.

4. The winding of claim 1, wherein the cylindrical turns have portions which extend along the direction of the turn and portions which extend angled to the direction of the turn.

5. The winding of claim 1, wherein the cylindrical turns have linear portions which extend along the direction of the turn and portions which extend angled to the direction of the turn, wherein the angled portions have different widths or diameters than the linear portions.

6. The winding of claim 1, wherein the width of each cylindrical turn current path decreases towards the first and second inner edges.

7. The winding of claim 1, wherein the widths of the current paths in the first planar section are smaller than the widths of the current paths in the second planar section.

8. The winding of claim 1, wherein the cylindrical turns of the first and second planar sections are conductive layers.

9. The winding of claim 1, wherein an end of one or more cylindrical turns is extended along an edge to increase the distance between one or more cylindrical turns.

10. A high voltage transformer comprising a winding of claim 1.

11. A high voltage transformer comprising a winding of claim 1, wherein the winding is a primary winding.

12. A high voltage transformer comprising a winding of claim 1, wherein the winding is a secondary winding.

13. A computer tomography apparatus comprising a high voltage transformer comprising a winding of claim 1.

* * * * *